US008997884B1

(12) United States Patent
Morlier

(10) Patent No.: US 8,997,884 B1
(45) Date of Patent: Apr. 7, 2015

(54) WILD FIRE AND STRUCTURE FIRE CONTAINMENT AND BARRIER SYSTEM

(76) Inventor: John Michael Morlier, Austin, TX (US)

( * ) Notice: Subject to any disclaimer, the term of this patent is extended or adjusted under 35 U.S.C. 154(b) by 485 days.

(21) Appl. No.: 13/427,073

(22) Filed: Mar. 22, 2012

(51) Int. Cl.

| | |
|---|---|
| ***A62C 8/00*** | (2006.01) |
| ***A62C 2/00*** | (2006.01) |
| ***A62C 3/00*** | (2006.01) |
| ***A62C 2/24*** | (2006.01) |
| ***A62C 2/10*** | (2006.01) |
| ***A62C 3/02*** | (2006.01) |
| *A62C 2/04* | (2006.01) |
| *A62C 2/06* | (2006.01) |

(52) U.S. Cl.
CPC ... *A62C 2/24* (2013.01); *A62C 2/10* (2013.01); *A62C 3/0257* (2013.01); *A62C 2/04* (2013.01); *A62C 2/06* (2013.01)

(58) Field of Classification Search
CPC ..... A62C 2/10; A62C 3/0257; A62C 2/05; A62C 2/06; A62C 8/06
USPC ..... 169/43–47, 48–50; 244/24, 31, 129.2, 244/137.4
See application file for complete search history.

(56) References Cited

U.S. PATENT DOCUMENTS

| | | | | |
|---|---|---|---|---|
| 589,062 | A | 8/1897 | Woodruff | |
| 951,681 | A | 3/1910 | Dunlevy | |
| 973,936 | A | 10/1910 | Graves | |
| 3,489,072 | A * | 1/1970 | Secor | 454/1 |
| 3,635,290 | A | 1/1972 | Schneider | |
| 4,311,199 | A | 1/1982 | Elias | |
| 5,944,114 | A | 8/1999 | Farley | |
| 6,070,640 | A * | 6/2000 | Miyagawa et al. | 160/121.1 |
| 7,334,644 | B1 * | 2/2008 | Ozment | 169/46 |
| 7,832,492 | B1 | 11/2010 | Eldridge | |
| 7,866,101 | B2 | 1/2011 | Boggs, Jr. | |
| 8,297,371 | B1 * | 10/2012 | Musser, Jr. | 169/48 |
| 2005/0161235 | A1 | 7/2005 | Chuprin | |
| 2008/0257977 | A1 * | 10/2008 | Chan et al. | 239/14.1 |
| 2009/0194297 | A1 | 8/2009 | Ortiz Teruel | |
| 2010/0300707 | A1 * | 12/2010 | Kolios | 169/48 |
| 2011/0067891 | A1 * | 3/2011 | Linares | 169/48 |

FOREIGN PATENT DOCUMENTS

| | | |
|---|---|---|
| ES | 2124134 | 1/1999 |
| ES | 1048262 | 7/2001 |
| ES | 200601499 | 5/2006 |
| FR | 561289 | 10/1923 |
| FR | 924016 A | 7/1947 |

(Continued)

*Primary Examiner* — Len Tran
*Assistant Examiner* — Alexander Valvis

(57) ABSTRACT

Several embodiments of a wildfire and structure fire containment system by means of a fire-resistant Mesh Sheet (13). Said Mesh Sheet (13) is held aloft by a fire resistant Balloon (11) or Balloons (21) which are filled with a lighter-than-air material comprising gas, plasma, liquid, solid, or a combination. Propellants (10) are attached to said Balloon (11) or Balloons (21). A fire resistant Base or Anchor (16) is along the bottom edge of said Mesh Sheet (13). One or more additional said Mesh Sheets (13) can be attached horizontally using a Lip (32) and Channel (31) system. Additional said Mesh Sheets (13) can be added to vertically extend the embodiment to higher elevations. A Flap (14) exists covering an opening on the bottom section of the Mesh Sheet (13). Various electronic cameras, heat sensors, wind sensors, and other electronic and digital devices can be attached.

10 Claims, 10 Drawing Sheets

(56) References Cited

FOREIGN PATENT DOCUMENTS

| | | |
|---|---|---|
| FR | 1009783 | 6/1952 |
| FR | 2204973 | 5/1974 |
| FR | 2620344 A1 | 9/1987 |
| FR | 2657265 | 7/1991 |
| FR | 2677548 | 12/1992 |
| FR | 2806636 | 9/2001 |
| FR | 2863895 | 6/2005 |
| GB | 2276543 | 3/1994 |

* cited by examiner

Firewall

Firewall (Side view)

Alternative Embodiment Aerodynamic Balloons and Propellants (Side View)

Alternative Embodiment: Side Channels and Lips to connect Mesh Sheet

Alternative Embodiment: Side Channels and Lips to connect Mesh Sheets (from top looking down)

Lip slotted through Channel (from top looking down)

Alternative Embodiment – Heat and wind sensing devices, and video cameras attached to Firewall Alternative Embodiment, Vertical Extension Offensive Firewall Deployment with Wildfire Defensive Firewall Deployment Urban Structure Firewall Deployment (Offensive and Defensive)

WILD FIRE AND STRUCTURE FIRE CONTAINMENT AND BARRIER SYSTEM

BACKGROUND

Prior Art

The following is a tabulation of some prior art that presently appears relevant:

| U.S. Patents | | | |
|---|---|---|---|
| Pat. No. | Kind Code | Issue Date | Patentee |
| Containment and Barrier Walls | | | |
| 589,062 | | Aug. 31, 1897 | Woodruff |
| 951,681 | | Mar. 8, 1910 | Dunlevy |
| 973,936 | | Oct. 25, 1910 | Graves |
| 4,311,199 | | Jan. 19, 1982 | Elias |
| 5,944,114 | | Aug. 31, 1999 | Farley |
| Containment and Barrier Curtains (Ground Based) | | | |
| 2009/0194297 | A1 | Aug. 6, 2009 | Teruel |
| Containment and Barrier Curtains (Air supported) | | | |
| 3,635,290 | | Jan. 9, 1972 | Schneider |

| Foreign Patent Documents | | | | |
|---|---|---|---|---|
| Foreign Doc Nr. | Cntry. Code | Kind Code | Pub. Dt. | App or Patentee |
| Containment and Barrier Walls | | | | |
| 924016 | FR | A | Jul. 4, 1947 | Dutroy |
| 2620344 | FR | A1 | Sep. 14, 1987 | Renoux |
| 2276543 | GB | | Mar. 25, 1994 | Mech-Tool |
| 2124134 | ES | | Jan. 16, 1999 | Puente |
| Containment and Barrier Curtains (Ground Based) | | | | |
| 561289 | FR | | Oct. 10, 1923 | Jacquement |
| 1009783 | FR | | Jun. 3, 1952 | Leprevost |
| 2657265 | FR | | Jul. 26, 1991 | Plantefeve |
| 2677548 | FR | | Dec. 18, 1992 | Plantefeve |
| 1048262 | ES | | Jul. 1, 2001 | Morgado |
| 2806636 | FR | | Sep. 28, 2001 | Tonchia |
| 2863895 | FR | | Jun. 24, 2005 | Tonchia |
| 200601499 | ES | P | May 31, 2006 | Teruel |
| Containment and Barrier Curtains (Air supported) | | | | |
| 2204973 | FR | | May 24, 1974 | Valette |

BACKGROUND OF THE INVENTION

Currently wildland and urban fire fighters have generally only two tactics to stop a wildfire or a structure fire. The first tactic is to simply douse the fire with water or fire retardant chemicals. The second tactic is to separate the burning area from the non-burning area by clearing a fire line of fuels down to mineral soil. The width of the fire line depends on topography, fire intensity, and wind. On slopes, in more intense fire, and in moderate winds, the fire line must be wider. However fires often jump even these fire lines. Indeed, when a forest fire spreads to the canopies of a forest, it is called a "crown fire" and is beyond the direct control of fire fighters because of its distance from the ground. The embodiments herein are new tools that can be used to improve the second tactic by extending the fire line vertically in a plane to a height well above the fire. Wildfire flames are documented to rise as high as 150 feet[1]. Wildfire heat is documented to exceed 2,192 degrees Fahrenheit.[1]

(1) *At What Temperature does a forest fire burn*?, Wildfire Today, http://wildfiretoday.com/2011/02/26/at-what-temperature-does-a-forest-fire-burn/

Heat moves in three ways: conduction, convection, and radiation. The embodiments described herein prevent the spread of heat in all three ways. These embodiments stop the conduction of heat through air, the convection of heat that rises above a fire, and the radiation of heat onto fuels that are behind the embodiment. These embodiments prevent fire brands, cinders, and embers from spreading to a height equal to the height of the vertical wall plane.

Prior art has proposed several less effective methods to block wildfires and structure fires. These methods can be grouped into three categories which are 1. Containment and barrier walls which are solid walls that rest on the ground.
2. Containment and barrier curtains which rest on the ground.
3. Containment and barrier curtains which are supported by some airborne method.

Containment and barrier walls which are solid walls that rest on the ground

The following patents fall into this category:

U.S. Patents

U.S. Pat. No. 589,062 to Woodruff (1897)

U.S. Pat. No. 951,682 to Dunlevy (1910)

U.S. Pat. No. 973,936 to Graves (1910)

U.S. Pat. No. 4,311,199 to Elias (1982)

U.S. Pat. No. 5,944,114 to Farley (1999)

Foreign Patents

FR924016 to Dutroy (1947)

FR2620344 to Renoux (1987)

GB2276543 to Mech-Tool (1994)

ES2124134 to Puente (1999)

These walls are 1. heavy,
2. limited in height,
3. difficult to transport, setup, tear down, and move,
4. labor intensive to setup, move, and tear down, and
5. time consuming to setup and move.
6. While these walls protect a person immediately behind the wall, they do not prevent the spread of a fire due to conduction, convection, or radiation because cinders, embers, and sparks will be blown over the wall and flames will extend well above the wall.

Containment and Barrier Curtains which Rest on the Ground

The following patents fall into this category:

U.S. Patents

2009/0194297 to Teruel (2009)

Foreign Patents

FR561289 to Jacquement (1923)

FR1009783 to Leprevost (1952)

FR2657265 to Plantefeve (1991)

FR2677548 to Plantefeve (1992)

ES 1048262 to Morgado (2001)

FR2806636 to Tonchia (2001)

FR2863895 to Tonchia (2005)

ES2006/0001499 to Teruel (2006)

These curtain systems exhibit the same disadvantages as the solid walls. They are 1. heavy,
2. limited in height,
3. difficult to transport, setup, tear down, and move,
4. labor intensive to setup, move, and tear down, and 5. time consuming to setup and move.
6. While these curtain systems protect a person immediately behind the wall, they do not prevent the spread of a fire due to conduction, convection, or radiation because cinders, embers, and sparks will be blown over the curtain and flames will extend well above the curtain.
7. Additionally they require that the bottom of the curtain be pegged to the ground, that the top of the curtain be supported by horizontal or vertical rods, and that the top of the curtain be held in fixed position by guy lines pegged into the ground at some distance on both sides of the curtain. These requirements make the curtain barrier immobile and inflexible. One result is that the guy wires or ropes on the fire side of the curtain will be in the fire and therefore must be capable of withstanding the heat of the fire, which for a wildfire can be as much as 2,192 degrees Fahrenheit.

Containment and Barrier Curtains which are Supported by Some Airborne Method

The following patents fall into this category:
U.S. Pat. No.
U.S. Pat. No. 3,635,290 to Schneider (1972)
Foreign Patents
FR2204973 to Valette (1974)

Schneider's invention, U.S. Pat. No. 3,635,290, uses hot air balloons to support from above "sails" which are pegged to the ground at their bottom. The sail is designed with a scooped or curved shape so that the heat and wind from the fire are "trapped thereunder thereby helping keep the sails erect." Several disadvantages of this embodiment are 1. The bottom of the sail is fixed in place by the pegs on its bottom edge making it difficult to move. The use of pegs in the ground to secure the guide lines to the hot air balloons requires that the soil be soft enough to allow the peg to go into it, but yet hard enough so that the peg will not come out even under the pressure of the wind being trapped under the sail.

2. Each hot air balloon has a heat generator in the basket under the balloon. These heat generators require combustible fuel, which may become exhausted at which point the balloon will fall. The set up of this invention requires that someone light the heat generator in the basket and allow enough time for the hot air thus created to fill and lift the balloon.

3. The scoop that traps the heat and wind will accumulate soot and carbon, thus weighing it down. Wildfires generate winds of up to 80 miles per hour. With nowhere to go in the sail, the trapped wind will place a great pressure on the sail, thereby pushing the entire apparatus down. Sails on boats are designed to capture wind so that the boat will move. The sails illustrated in this invention operate the same way except that the sail is anchored to the ground. Since the bottom of the sail here is fixed to the ground, the result will be that the entire sail will be pushed down in spite of the hot air balloons.

4. This invention has hooks and eyelets on the sides of the scoop so that additional sails can be connected together to extend the width of the sail. However, once a sail is erected, these hooks and eyelets are inaccessible. The determination to connect sails has to be made before a sail is erected.

5. The deployed hot air balloons are fixed in position by guide lines that extend in front of and behind the sail. These lines are secured by pegs in the ground. This places the guide lines in the front and their pegs in the fire area. This makes them vulnerable to wildfire heat that can be as high as 2,192 degrees Fahrenheit.

Valette's invention, FR2204973, employs a "membrane" supported by "envelopes" filled with a lighter than air gas, such as nitrogen. Valette uses pegs at the only the base of the membrane to hold it down. There are no guide lines in front or back of the membrane. As Valette states, this makes the floating membrane sensitive to the wind. His drawings show the wind coming from the direction of the fire pushing the membrane down over trees behind the membrane. The intent seems to be for the membrane to be pushed by the wind down to cover and protect the trees immediately downwind of the membrane, rather than to contain the wildfire with a barrier. That is, the scope and intent of this invention is not to contain a wildfire, but to simply protect the trees immediately downwind of the membrane. Several disadvantages of this embodiment are 1. By design, the membrane is pushed down by the wind and so does not prevent heat conduction, convection, or radiation from spreading the fire. Cinders and embers are carried by the rising heated air above the wildfire and then wind currents at a higher elevation blow them a distance. These hot embers are deposited a distance from the original fire to start a new fire.

2. The securing pegs require soil that is soft enough to allow the peg to be driven in, but yet soil hard enough so that the peg does not come out under the pressure of the wind.

3. There is not description as to connecting membranes to expand their coverage.

SUMMARY OF THE INVENTION

The various embodiments comprise a fire-resistant sheet with a flap that can be opened and closed over an opening, a balloon along the top edge, propellants at the balloon, an anchor at the base of the sheet, and seams or connectors to connect the sheet to the balloon at the top and to the anchor at the bottom.

Advantages

Accordingly several advantages of one or more aspects are as follows: to provide a vertical fire barrier that extends well above a wild fire or structure fire as a means to prevent the spread of the said fire by convection, conduction, or radiation of heat; to provide a means for animals and firefighters to pass through the barrier and close the barrier as needed; to provide a lighter than air balloon along the top from which to hang the said barrier; to provide a light weight embodiment that is easy to transport, setup, move, and tear down; to provide a light weight embodiment that is not labor or time intensive to set up, move, or tear down; to provide a means to dynamically position the top edge of the embodiment; to provide a means to extend the fire-resistant barrier higher and wider as needed without bringing the deployed barrier down; and to provide a secure movable base for the embodiment to anchor the entire structure.

REFERENCE NUMERALS ON DRAWINGS

Figure 1A:
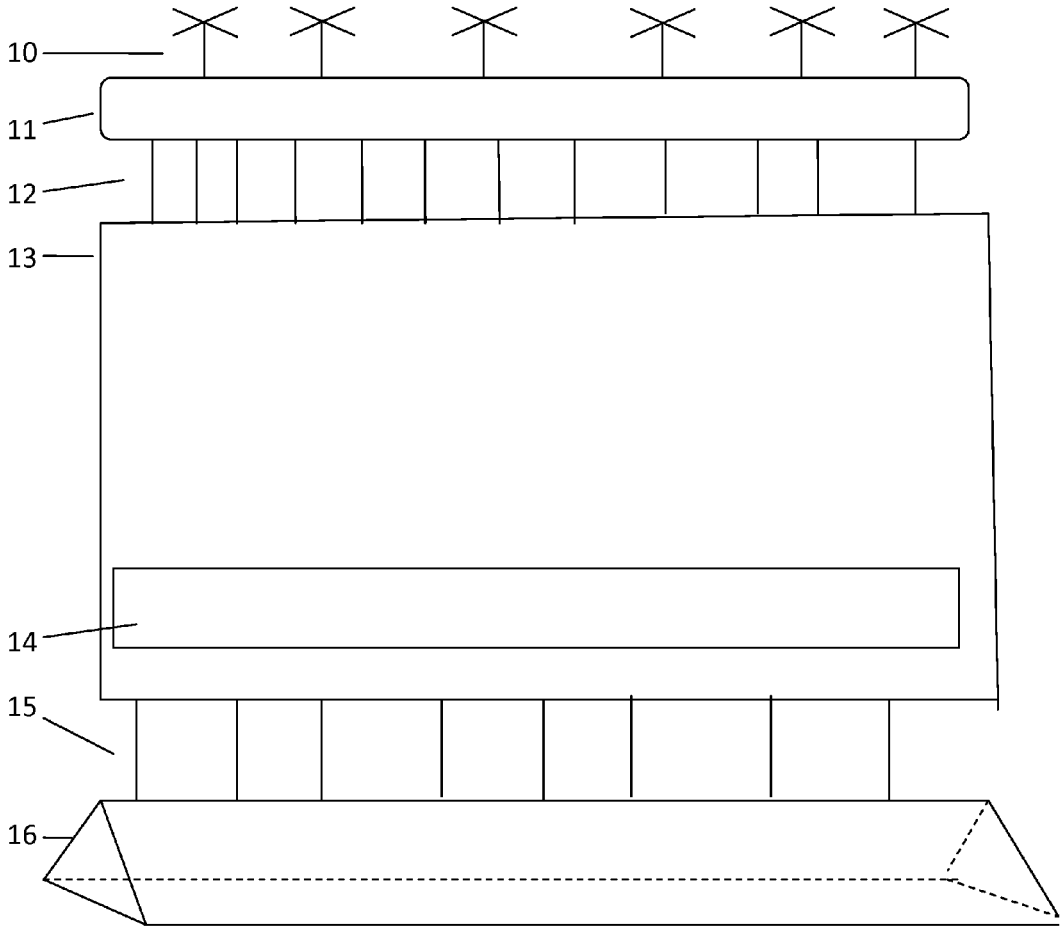
FIGS. 1A and 1B show all the components of a single Firewall.

10 Propellants, propellers or jets
11 Balloon
12 Seams or connectors
13 Mesh sheet
14 Flap
15 Seams or connectors
16 Base or Anchor
21 Aerodynamic Balloon
31 Channel
32 Lip
41 Video Camera and transmitter
42 Electrical strips, heat sensors, wind sensors, and data transmitters
52 Connectors between one Mesh Sheet and a second Mesh Sheet attached above it
53 An additional Mesh Sheet connected vertically in line with the initial Mesh Sheet
6A Firewall deployed upwind of a wildfire
6B Wind vector
6C Wildfire
6D Firewall deployed downwind of a wildfire
7A Firewall deployed around a structure
7B Structure to be protected from fire
7C Wildfire approaching an isolated structure
8A Street
8B Houses not on fire and to be protected
8C Firewall deployments around a burning house
8D Burning House

DETAILED DESCRIPTION OF THE PREFERRED EMBODIMENTS

Figure 1B:
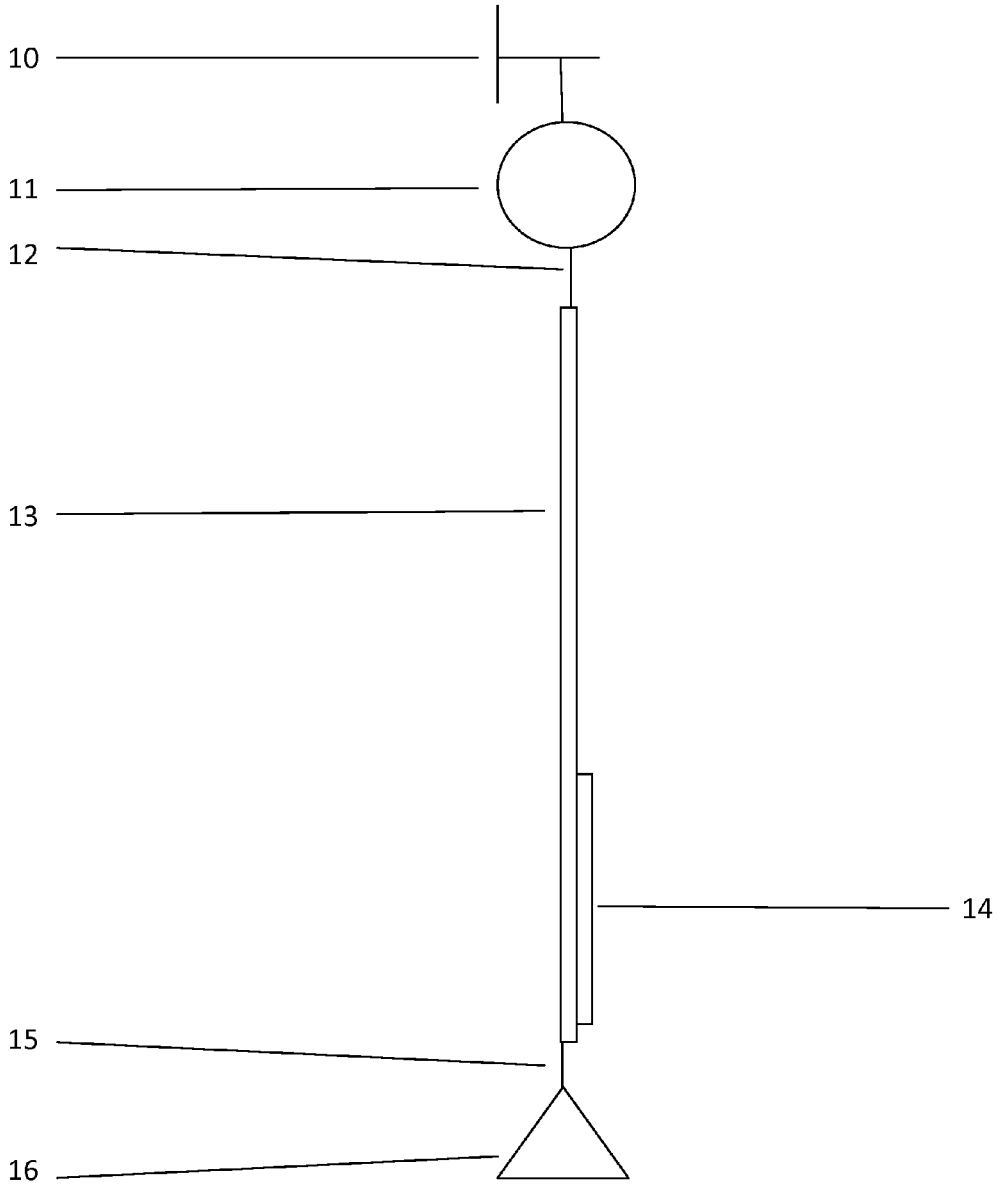
Figure 2:
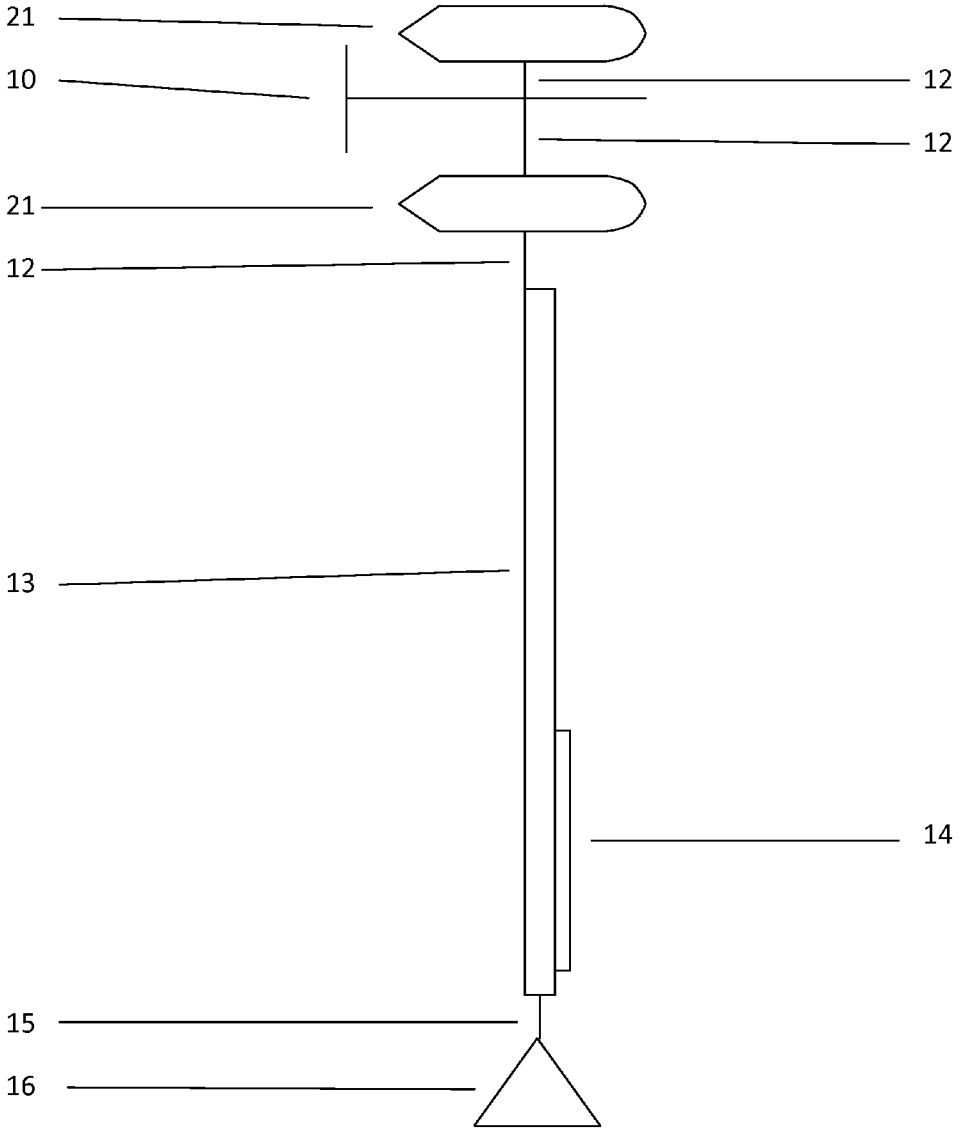
FIG. 2 shows an embodiment of the Firewall with aerodynamic balloons above and below the Propellants.

FIGS. 1A and 1B

Detailed Description of First Embodiment

One embodiment of the Firewall is illustrated in FIGS. 1A and 1B (side view). The central component is the Mesh Sheet (13). Said Mesh Sheet (13) constitutes a means to prevent cinders, embers, and heat from passing through it, a means to allow wind to pass through it, and is light enough as a means to allow a Balloon (11) to hold it aloft. Said Mesh Sheet (13) can be any height so long as it is high enough to exceed the height of a wildfire or structure fire. Said Mesh Sheet (13) is wide enough to protect a predetermined distance along a fire line, but not so wide as to be unmanageable in transporting and setting up. Said Mesh Sheet (13) is made of a material which is light-weight enough for the Balloon (11) (21) to lift said Mesh Sheet (13) and hold it up. Alternatively, said Mesh Sheet (13) can be made of a lighter-than-air material, comprising gas, plasma, liquid, or solid, or a combination of these, so that it reduces the buoyancy required of a supporting Balloon (11). One possible solid material would be an aerogel available from Aspens Aerogels (http://www.aerogel.com/products/overview-product.html). Said Mesh Sheet (13) must be fire resistant to a temperature well over the temperature of the wildfire or structural fire.

In one embodiment of said Mesh Sheet (13) fibers, threads, or strips of fire-resistant material are woven alternating with fibers, threads, or strips of fire-reflecting fire-resistant material. This alternating structure of weaving in the said Mesh Sheet (13) addresses the containment of conduction heat by the fire resistant fibers, threads, or strips, and the containment of radiant heat by the fire-reflecting fire-resistant fibers, threads, or strips. Another embodiment of said Mesh Sheet (13) could have the horizontal fibers, threads, or strips made of fire-resistant material and the vertical fibers, threads, or strips made of fire-reflecting fire-resistant material in order to block both conduction heat and radiant heat. Another embodiment of said Mesh Sheet (13) could have the horizontal fibers, threads, or strips made of fire-reflecting fire-resistant material and the vertical fibers, threads, or strips made of fire-resistant material.

In this embodiment, said Mesh Sheet (13) has a Flap (14) in the lower section. Said Flap (14) covers an opening. Said Flap (14) can be on either side (front or back) of the said Mesh Sheet (13). The top edge of said Flap (14) is permanently attached to said Mesh Sheet (13). The sides and bottom edges of said Flap (14) have securing devices along the edges. Said Flap (14) constitutes a means for animals to escape through the said Mesh Sheet (13). Said Flap (14) also constitutes a means for firefighters to access a wildfire area from a place of safety and exit from a wildfire area to a place of safety.

In this embodiment, the said Mesh Sheet (13) has a Balloon (11) along its top edge that uses a lighter than air gas, plasma, liquid, or solid to lift and support the said Mesh Sheet (13) as well as the said Balloon (11) material that contains the lighter than air material including gas, plasma, liquid, or solid. The said Balloon (11) must also provide sufficient lift to support the Propellants (10) along the top edge of the said Balloon (11). In this embodiment, the said Balloon (11) provides structure for the top edge of the said Mesh Sheet (13). Said Balloon (11) material and the lighter-than-air material comprising gas, plasma, liquid, solid, or a combination must be fire resistant to temperatures that exceed the temperature of the wild fire or structure fire. One embodiment of this supporting structure could be balloon(s) that run along the length of the top edge of the said Mesh Sheet (13). These balloons could be filled with a fire resistant lighter-than-air gas such as Helium. An alternative embodiment of the said Balloon (11) uses a lighter-than-air solid such as an aerogel, which are available from Aspen Aerogels (http://www.aerogel.com/products/overview-product.html).

In this embodiment, the top edge of said Mesh Sheet (13) is attached to said Balloon (11) by a continuous Seam (12) or a series of Connectors (12). Said Seam (12) and said Connectors (12) are fire resistant to a temperature in excess of temperatures anticipated at a wild fire or structural fire. The required feature of said Seam (12) and said Connectors (12) is to connect the top edge of the said Mesh Sheet (13) to said Balloon (11). Said Seam (12) and said Connectors (12) are to be light weight enough to be supported by said Balloon (11).

In this embodiment, said Propellants (10) along the top edge of said Balloon (11) provide lateral control of the position of the top edge of said Mesh Sheet (13). Said Propellant (10) can be propellers driven by a battery or driven by an engine. Alternatively said Propellants (10) could be jet engines. The required feature is an ability to provide controlled thrust to the top edge of the embodiment. One embodiment of said Propellants (10) uses drone technology available from, among other companies, AeroVironment (http://www.avinc.com/).

In this embodiment, the bottom edge of the said Mesh Sheet (13) is attached to the Base or Anchor (16) by a continuous Seam (15) or a series of Connectors (15). Said Seam (15) and said Connectors (15) are fire resistant to a temperature in excess of temperatures anticipated at a wild fire or structural fire. The required feature of said Seam (15) and said Connectors (15) is to connect the bottom edge of said Mesh Sheet (13) to said Base or Anchor (16). Said Seam (15) or said Connectors (15) are to be light weight enough to be supported by the said Balloon (11).

In this embodiment, said Base or said Anchor (16) runs along the bottom of said Mesh Sheet (13). Its required feature is that it provides enough weight to hold the entire structure down and securely in place. Said Base or Anchor (16) is fire resistant to a temperature in excess of temperatures anticipated at a wild fire or structural fire.

FIGS. 1A and 1B

Operation of First Embodiment

The purpose of the embodiment is to contain a wildfire or a structure fire. It creates a wall to block the spread of the fire, the cinders, the embers produced by the fire, and the heat produced by the fire. The embodiment height exceeds the height of the flames so that it can block the cinders, embers, and heat that are pushed above the flames.

The Firewall is deployed along a control line that has been cleared of fuel down to mineral soil. This is so that a fire cannot run under said Base or Anchor (16) of the Firewall. When a crew of operators brings a Firewall to a control line site, the deflated Balloon (11)(21), Seams or Connectors (12) (15), and Mesh Sheet (13) are folded and tied to the Base or Anchor (16) to form a transportable package. Said Base or Anchor (16) is pre-filled or filled on site with a heavy and fire resistant material such as, for example, sand. The folded and tied package is laid out along the control line. The package is then untied. If said Balloon (11)(21) embodiment is a fire resistant material to be filled with a lighter-than-air gas, plasma, or liquid, then said Balloon (11) (21) is filled on site with the lighter than air gas, plasma, or liquid. Alternatively, if said Balloon (11)(21) embodiment is a fire resistant lighter-than-air solid, then no inflation is necessary. In this case the lighter-than-air solid Balloon (11)(21) must be held down until deployment is desired. Guy lines are attached to said Balloon (11)(21) on the back side of said Balloon (11)(21). The back side of said Balloon (11)(21) is the side which will be away from the fire. Said Balloon (11)(21) is gradually raised, using the guy lines, to its full height. Said Propellants (10) are tested at ground level and then turned off. When said Balloon (11)(21) reaches an elevation where a wind starts to push said Balloon (11)(21) forwards or backwards perpendicular to the plane of the said Mesh Sheet (13), said Propellants (10) are turned on to control the position of said Balloon (11)(21) and the top edge of said Mesh Sheet (13).

Said Flap (14) is opened to allow animals to escape the fire through the opening in the bottom of said Mesh Sheet (13). Said Flap (14) has to be tall enough to allow the tallest animal to pass through. For example, it could be ten feet to allow a moose or bear to pass through. At some point, said Flap (14) is closed to complete the Firewall.

Said Flap (14) also constitutes a means of access for fire fighters to cross the fire control line at a secure point to get to a fire. Said Flap (14) also serves as an escape door for fire fighters moving away from a fire. They can go through said Flap (14) to get to safety behind the Firewall.

FIG. 2

Detailed Description of Second Embodiment

This embodiment differs from the first embodiment in that there are two Balloons (21), one above said Propellant (10) and one below said Propellant (10). Said Balloons (21) are aerodynamically designed like an airplane's wings. The aerodynamically shaped Balloons (21) are made of fire resistant material filled with a lighter-than-air material comprising gas, plasma, or liquid. Alternatively said Balloons (21) are made of a fire resistant lighter-than-air solid. There can be one or more aerodynamically shaped Balloons (21). These constitute a means to add lift to the Firewall and control the placement and movement of the top edge of the Firewall.

FIG. 2

Operation of Second Embodiment

Said Propellants (10), either propellers or jets, create an air stream over said Balloons (21). Said aerodynamically shaped Balloons (21) act like airplane wings and the air stream over and under them provides additional lift to the entire structure. Said aerodynamic Balloons (21) also enhance said Propellants' (10) ability to pull said Balloons (21) and the top edge of said Mesh Sheet (13) forward.

Figure 3A:
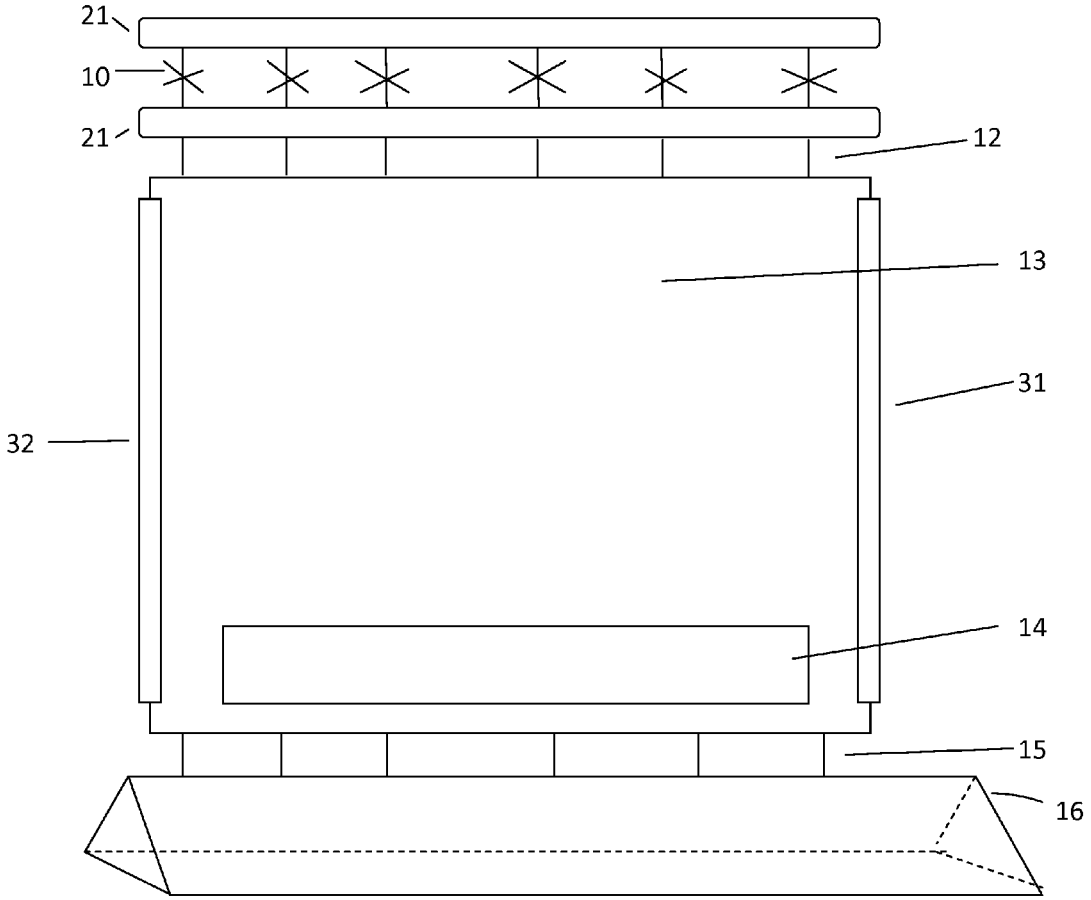
FIGS. 3A and 3B show an embodiment of the Firewall with Channels and Lips on the Sides of the Mesh Sheet.
Figure 3B:
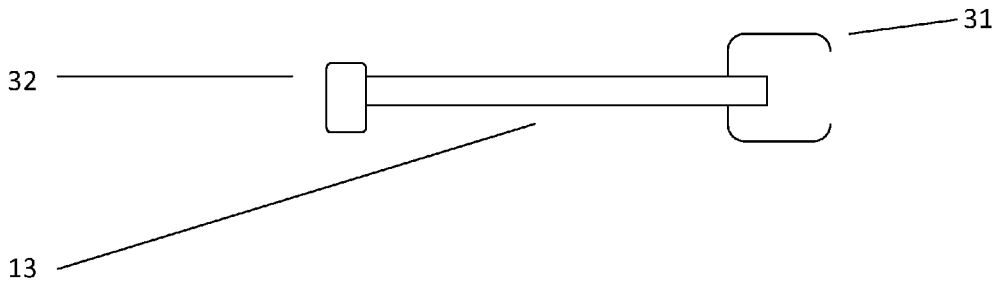
Figure 3B:
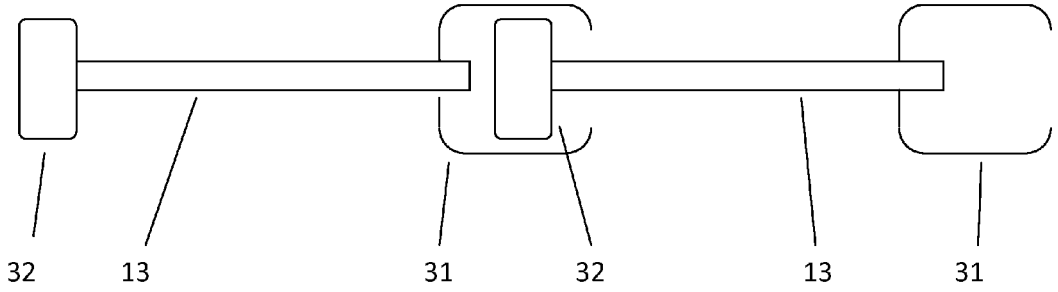
Figure 4:
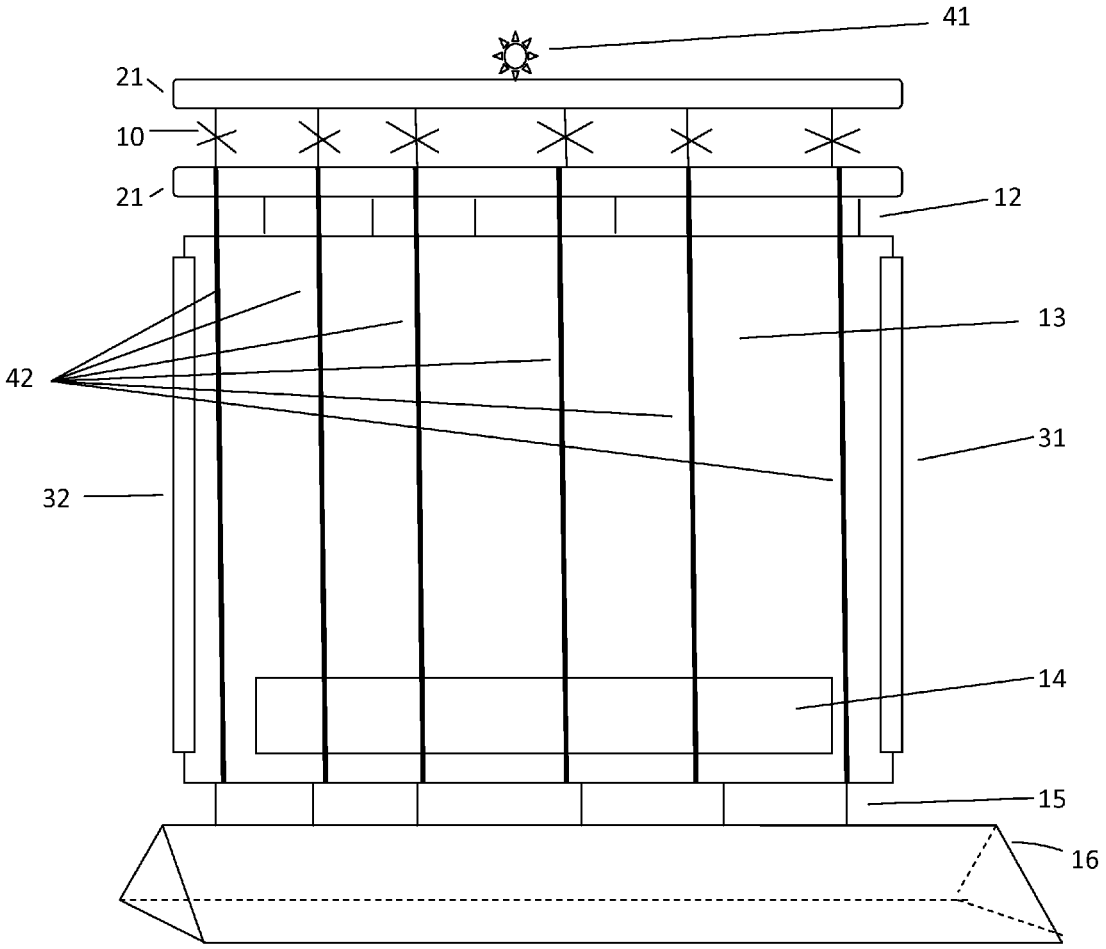
FIG. 4 shows an embodiment FIG. 1A with a video camera and strips to gather heat data, to gather wind data, to carry electrical power, and/or to transmit data.
Figure 5:
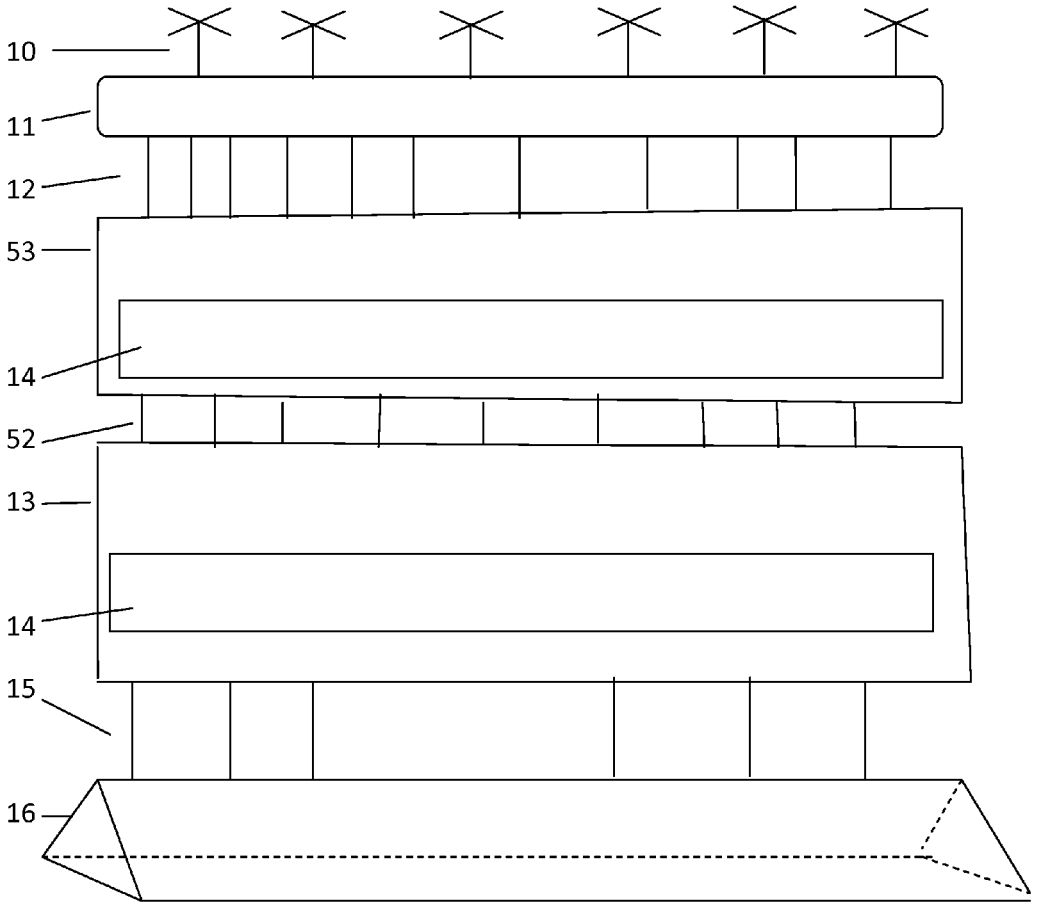
FIG. 5 shows all the components of FIG. 1A with addition of a second Mesh Sheet to increase the vertical height of the Fire wall.
Figure 6:
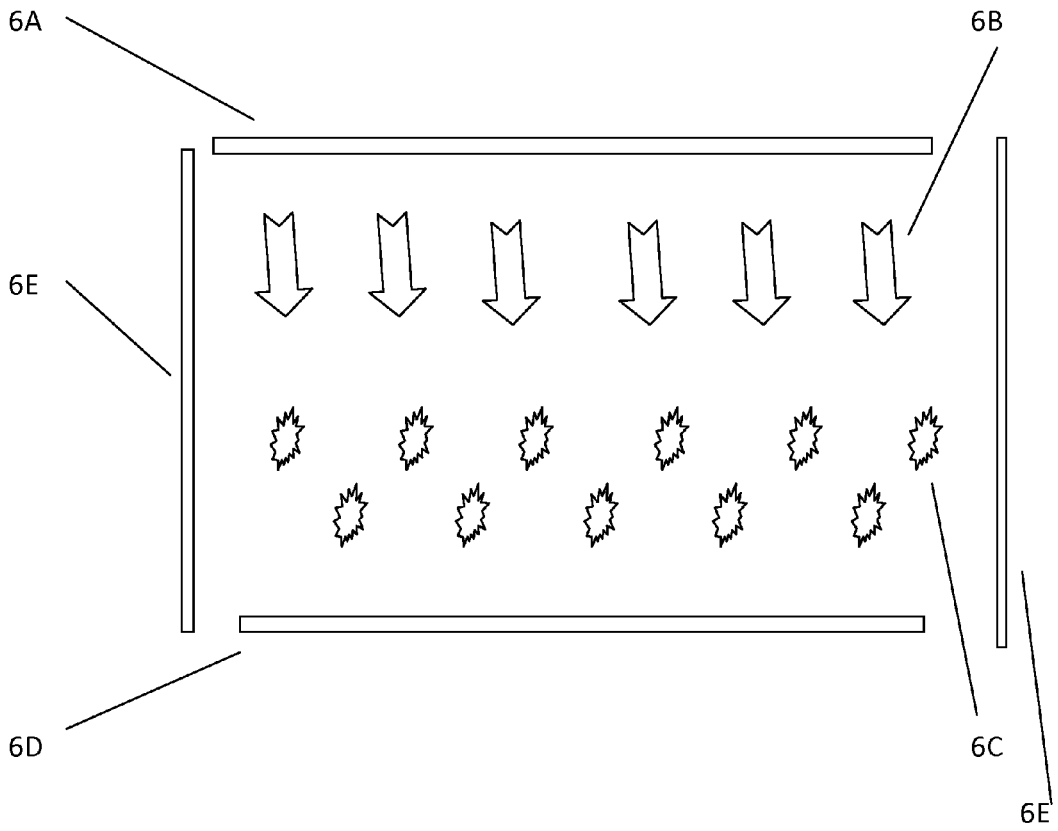
FIG. 6 shows an offensive deployment of an embodiment around a wildfire.
Figure 7:
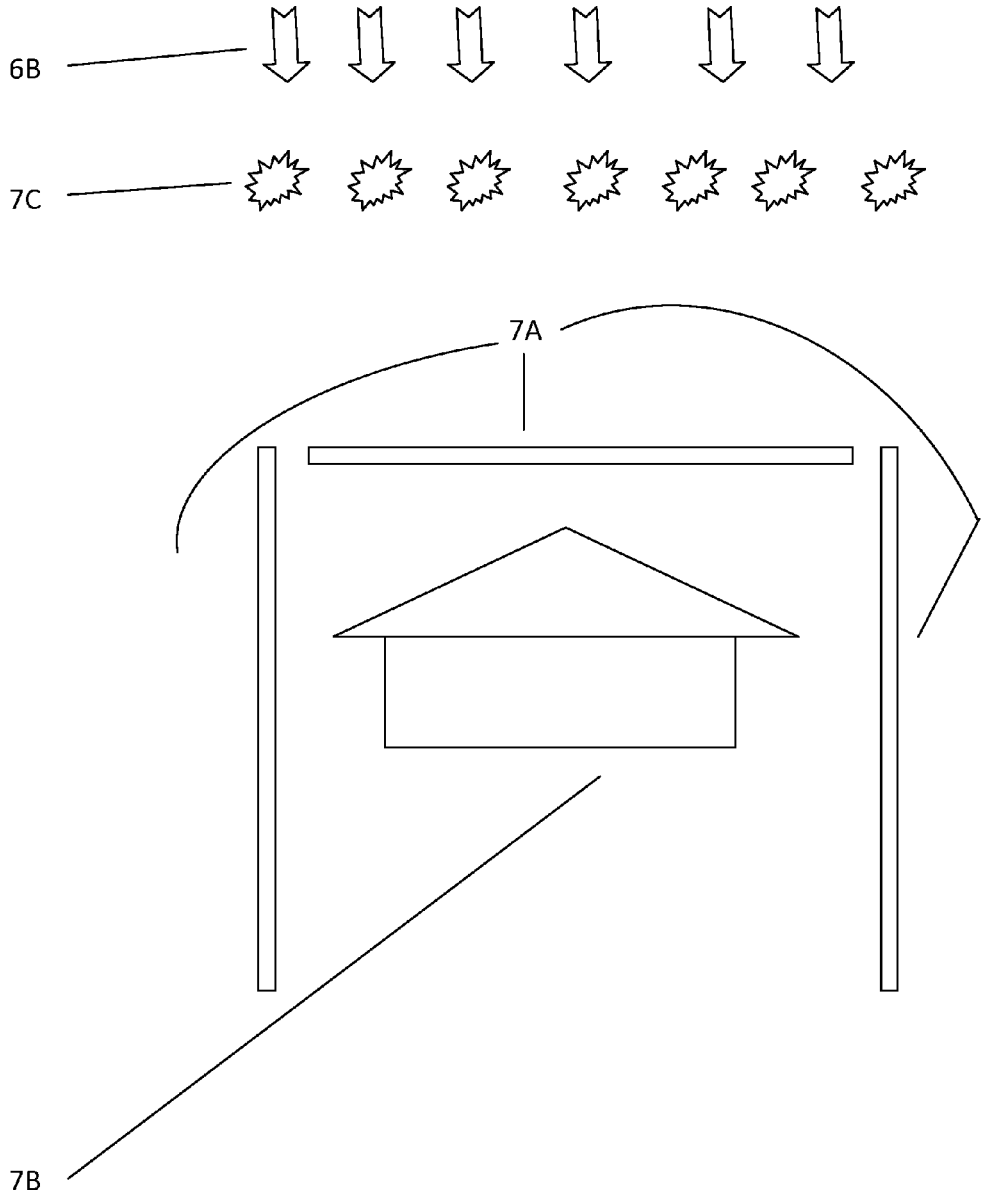
FIG. 7 shows a defensive deployment of an embodiment around a structure on fire.
Figure 8:
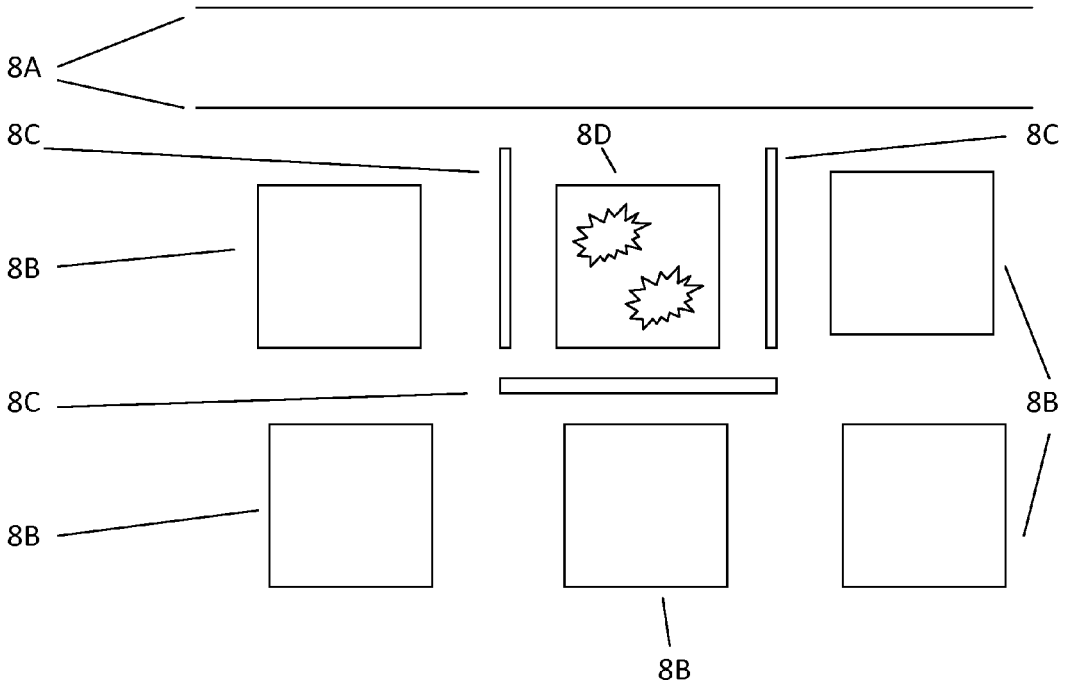
FIG. 8 shows a defensive containment deployment of an embodiment around a structure fire in a densely built-up neighborhood.

FIGS. 3A and 3B

Detailed Description of Third Embodiment

This embodiment shows a Lip and Channel system. Each Mesh Sheet (13) will have a Lip (32) on one side edge and a Channel (31) on the opposite side edge. Said Lip (32) and Channel (31) material is fire resistant to a temperature that exceeds the temperatures found in a wildland fire or structural fire. Said Lip (32) and Channel (31) are made of light weight material, a lighter-than-air material if possible. Said Lip (32) is sized and designed to fit loosely, but securely, into said Channel (31).

FIGS. 3A and 3B

Operation of Third Embodiment

Firewalls can be connected by threading said Lip (32) of one Mesh Sheet (13) through said Channel (31) of an adjacent Mesh Sheet (13). Thus, Firewalls can be seamlessly added onto each other. This constitutes a means to extend the Firewall along the fire control line.

In implementation, one embodiment will already be raised and deployed. To add a second embodiment, said Lip (32) of the second embodiment, which is still at ground level, is threaded into said Channel (31) of the deployed embodiment. Then, as the second embodiment is raised, said Lip (32) of the second Firewall threads up through said Channel (31) of the first deployed embodiment. Said Lip (32) in said Channel (31) has to be loose enough so that it does not bind or snag in said Channel (31), but said Channel (31) must overlap said Lip (32) enough so that said Lip (32) does not slip out of said Channel (31). Said Channel (31) on an embodiment extends to within about a foot of the bottom of said Mesh Sheet (13) so that an adjacent Mesh Sheet Lip (32) can be bent to be threaded into said Channel (31). Any number of Firewalls can thus be added to a fire control line to create a seamless Firewall along the entire length of a fire control line.

FIG. 4

Detailed Description of Fourth Embodiment

In this embodiment various Heat and Wind Sensing Devices (42) are attached to said Mesh Sheet (13) and said Balloon (11)(21) to provide data from the Firewall to a software package on the ground.

In this embodiment, metallic or quasi-crystalline Electrical Strips (42) are woven into said Mesh Sheet (13) from ground level to the battery power source for said Propellants (10).

In this embodiment Video Cameras (41) are attached to said Balloon(s) (11)(21) and transmit video images to a receiver attached to a computer on the ground. Said Video Cameras (41) can be attached anywhere on the embodiment to provide different vantage viewing points.

FIG. 4

Operation of Fourth Embodiment

Said Heat and Wind Sensors (42) could be woven into or attached to said Mesh Sheet (13) from ground level to the top of said Mesh Wall (13) to transmit temperature and wind information to a computer receiver where a software package could process the data. This would provide data on the changing temperature and wind levels from the ground to the top of the Firewall. Computer software would analyze this data to provide support for fire management decision support.

Said Electrical Metallic or quasi-crystalline Strips (42) woven into or attached to said Mesh Sheet (13) from the ground to said Propellants' (10) batteries would be used to supply electricity to the batteries. For example, quasi-crystalline wires are able to generate an electric current when heated. In one embodiment, the heat from the fire could be used to generate the current required to charge said Propellants' (10) batteries.

Said Video Cameras (41) could be placed on the balloons or anywhere on the embodiment to transmit real time video images to a ground station. These videos could be used for real-time fire management and/or be archived for future study. In this embodiment, the software package provides controls for a ground operator to control said Propellants (10) and provides software to process the data for decision support. In this embodiment said Video Camera is at the top of the Firewall on the top Balloon (11), however other embodiments could have one or more cameras anywhere on the embodiment to provide images from different vantage points.

FIG. 5

Detailed Description of Fifth Embodiment

A second Mesh Sheet (13) is added vertically to said initial Mesh Sheet (13) using Connectors (52).

FIG. 5

Operation of Fifth Embodiment

After a Firewall is deployed, it may become apparent that more height is required. To add height to the Firewall, the bottom edge of the second Mesh Sheet (13) is connected to said Base (16), without detaching the bottom connectors of said initial Mesh Sheet (13). When all the bottom connectors of said second Mesh Sheet (13) are connected to said Base (16), then the bottom connectors of said initial Mesh Sheet (13) are detached, one at a time, and connected to the top edge of said second Mesh Sheet (13). When all said Connectors (52) are reattached along the interface between said initial and second Mesh Sheets (13), then said second Mesh Sheet (13) is raised.

FIG. 6

Detailed Description of Offensive Deployment (6B) is the wind vector. Embodiments are deployed in front (downwind) (6D) of wildfire (6C), behind (upwind) (6A) of wildfire (6C), and on the sides (6E) of wildfire (6C).

FIG. 6

Operation of Offensive Deployment

The embodiment which is deployed downwind (6D) of a wildfire (6C) serves to prevent the spread of convection heat, conductive heat, radiant heat, cinders, embers, and burning air-born fuels.

The embodiment which is deployed upwind or behind (6A) a wildfire (6C) serves to prevent the spread of convection heat, conductive heat, radiant heat, cinders, embers, and burning air-born fuels. Also, this embodiment blocks the wind (6B) which provides the oxygen necessary for the wildfire (C6) to burn.

The embodiments which are deployed on the flanks or sides (6E) of a wildfire serve to prevent the spread of convection heat, conductive heat, radiant heat, cinders, embers, and burning air-born fuels. Also, this embodiment blocks the provision of oxygen to the wildfire (6C) from the sides.

FIG. 7

Detailed Description of Defensive Deployment

The embodiments are deployed around a non-burning structure to protect the structure from an approaching wildfire.

FIG. 7

Operation of Defensive Deployment

Embodiments (7A) are deployed completely around a non-burning isolated structure (7B) or around the sides of the non-burning structure (7B) which are downwind of an approaching fire (7C). The goal here is not to prevent the spread of the approaching wildfire (7C) but rather to protect the structure (7B) from burning when the approaching wildfire (7C) arrives at the structure (7B).

FIG. 8

Detailed Description of Urban Firewall Deployment

The embodiments (8C) are deployed around a burning structure (8D) which exists in an area with other structures in close proximity.

FIG. 8

Operation of Urban Firewall Deployment

The embodiments (8C) serve an offensive and a defensive role when the burning structure (8D) is located in close proximity to other non-burning structures (8B). Fire requires three components: heat, fuel, and oxygen. Offensively, the embodiments (8C) inhibit the provision of oxygen to the structure fire. This deprives the structure fire of one of the three necessary components for fire, i.e. oxygen. Defensively, the embodiments (8C) prevent the fire from spreading to neighboring non-burning structures (8B). Fires are spread by means of one or more of three types of heat: convective heat, conductive heat, and radiant heat. The embodiments block convective heat, conductive heat, and radiant heat from the neighboring non-burning structures (8B).

The embodiments (8C) can be deployed around several burning adjacent structures in a manner similar to the single structure (8D).

The Flap (14) on each embodiment allows firefighters and equipment ingress and egress to the fire area.

Advantages

From the descriptions above, a number of advantages of some embodiments of the Firewall become evident:

(a) The Firewall provides a vertical and horizontal barrier to the spread of wildfire, structure fire, cinders, embers, and heat.

(b) The Firewall can be extended horizontally as needed.

(c) The Firewall can be extended vertically as needed.

(d) The Firewall with video can provide visual images to a computer for real time fire management decision making and/or the images can be archived for future study.

(e) The Firewall with heat and wind sensors can provide data about the fire for real time fire management decision making and for future study.

(f) The Firewall provides a safety wall for fire fighters which they can use as a safe base to attack a fire.

(g) The Firewall provides a Flap (14) which, when open, allows animals to escape a wildfire. Said Flap (14) can be closed to complete a fire resistant wall past which the wildfire or structural fire cannot go. Said Flap (14) can also be used by firefighters to safely access a particular place on the fire line and then safely retreat behind said Flap (14) and Firewall.

(h) The Firewall can be used offensively by placing a Firewall in front of an advancing wildfire. This deployment constitutes a means to block cinders, embers, and heat from spreading. A Firewall can also be set up behind and on the sides of a wildfire to prevent the provision of oxygen to the wild fire.

(i) The Firewall can be used defensively by placing a Firewall around a neighborhood, subdivision, development, or single building in an intermix area where buildings are surrounded by wild land fuels. Even before a wildfire comes near to such a neighborhood, subdivision, development, or single residence, if a wildfire is anywhere in the area a Firewall can be set up around the structure.

(j) In a densely developed urban area, a Firewall can be set up on the sides of a structure fire to prevent it from spreading and to provide a safe control line for fire fighters to work through to douse the structure fire.

(k) Firewalls can preemptively be set up along lines in wild land areas in prior of any fire starting or in advance of a started wild fire. These could serve to slow the advance of the fire even if the Firewalls do not surround the wild fire.

(l) Firewalls can be installed in trenches to provide future use when a fire occurs. Thus the Firewall would be in place permanently. When a fire occurred, operators would simply raise the Firewall.

CONCLUSION, RAMIFICATIONS, AND SCOPE

Accordingly, the reader will see that, according to the various embodiments, the fire resistant Mesh Sheet (13) held up by the light-than-air Balloon (10), can be used to provide a fire containment wall that extends vertically well above a fire and can be extended horizontally in both directions around a fire. Embodiments of the Firewall can be used to contain a wildland fire, contain a structure fire, or protect a non-burning structure or neighborhood. The embodiment is laid out along a cleared fire control line, such as is currently normally made by wild land fire fighters. Alternatively the embodiment can be laid out on a naturally occurring fire resistant surface such as, for example, a rock escarpment, ridgeline, stream, or riverbank. Alternatively, the Firewall can be set up along a previously constructed surface, such as a highway, alley, or road that can also serve as a fire control line. The space above the fire line must be clear of branches and other obstacles so that the Balloon can rise without obstruction, lifting the Mesh Sheet top edge to a height above the fire. The embodiment can be deployed around a structure fire to prevent the spread of the fire. The embodiment can have various cameras, heat sensors, and wind sensors attached to transmit real time data to a computer receiver for processing and decision making.

While the above description contains many specificities, these should not be construed as limitations on the scope of any embodiment, but as exemplifications of various embodiments, thereof. Many other ramifications and variations are possible within the teachings of the various embodiments. For example, Firewalls could be used in an urban setting. If placed around a structure fire the Firewall will reduce the risk that the fire will spread to neighboring structures. Firewalls can be set up behind wild land fires and on the sides of wild land fires or structure fires to obstruct the inflow of the oxygen which is needed by the fire to burn. Such a deployment would also obstruct the spread of convection heat. A Firewall embodiment could be installed along the border of a subdivision in an underground trench, covered until needed for a fire event encroaching on the subdivision. At that time the trench cover could be removed and the Firewall embodiment would be deployed.

Thus the scope should be determined by the appended claims and their legal equivalents, and not by the examples given.

What is claimed is:

1. A fire containment system, comprising:

a mesh sheet comprising fire resistant material of a predetermined height and width, the mesh sheet comprising a weave configured to be tight enough to prevent cinders and embers from passing through and configured to be loose enough to allow the wind to pass through, further said mesh sheet configured to be light enough to be held aloft by a lighter-than-air aero-foil shaped support structure which substantially spans the length of said mesh sheet;

said lighter-than-air aero-foil shaped support structure is filled with a lighter-than-air material consisting of one of the following: gas, plasma, liquid, solid, and a combination thereof, and mounted directly along a top edge of said mesh sheet by a plurality of connectors or seams;

an anchor is directly attached to a bottom edge of said mesh sheet by a plurality of connectors or seams, said anchor has enough weight to hold down said mesh sheet and said lighter-than-air aero-foil shaped support structure and to prevent substantial movement of the system; and a propellant means comprising a plurality of drones mounted along the top of said lighter-than-air aero-foil shaped support structure, said propellant means facing the same directions as a front of said lighter-than-air aero-foil shaped support structure, said propellant means configured to provide lateral positioning control of said mesh sheet and said propellant means combined with the shape of said lighter-than-air aero-foil shaped support structure is configured to provide the vertical positioning control of said mesh sheet.

2. The fire containment system of claim 1, further comprising:

said mesh sheet has at a bottom section an opening and a flap which provides a means to pass through said mesh sheet.

3. The fire containment system of claim 1, further comprising:

wherein the system may have a second lighter-than-air aero-foil shaped support structure attached between the propellant means and the mesh sheet.

4. The fire containment system of claim 1, further comprising:

wherein said propellant means is powered by a battery source.

5. The fire containment system of claim 1, further comprising:

a plurality of sensors attached to any component of the system as a means to provide transmitted data.

6. The fire containment system of claim 5, further comprising:

wherein said plurality of sensors comprise a plurality of electrical strips which are woven into said mesh sheet and connected to a battery source of said propellant means and are configured to sense wind and heat and transmit the data.

7. The fire containment system of claim 1, further comprising:

a video camera attached to any component of the system as a means to provide visual images of the environment.

8. The fire containment system of claim 1, further comprising:

said mesh sheet further comprises a lip and a channel wherein a plurality of said mesh sheet can be attached together allowing the lip to fit loosely but securely into a corresponding channel of a second said mesh sheet.

9. The fire containment system of claim 1, further comprising:

wherein the system can comprise an additional mesh sheet directly connected to said mesh sheet by connectors or seams and said additional mesh sheet can further be connected to the propellant means.

10. The fire containment system of claim 1, further comprising:

wherein a plurality of said fire containment apparatus and systems can be used to surround a structure or area on fire.

* * * * *